US005571345A

United States Patent [19]

Ganesh et al.

[11] Patent Number: 5,571,345

[45] Date of Patent: Nov. 5, 1996

[54] THERMOMECHANICAL PROCESSING METHOD FOR ACHIEVING COARSE GRAINS IN A SUPERALLOY ARTICLE

[75] Inventors: Swami Ganesh, Clifton Park, N.Y.; Eric S. Huron, West Chester, Ohio

[73] Assignee: General Electric Company, Cincinnati, Ohio

[21] Appl. No.: 268,696

[22] Filed: Jun. 30, 1994

[51] Int. Cl.[6] ..... C22F 1/10

[52] U.S. Cl. ..... 148/514; 419/28; 419/29; 148/677; 148/902; 148/556; 148/527

[58] Field of Search ..... 419/28, 29, 61, 419/66; 148/675, 676, 677, 514, 527, 556, 902

[56] References Cited

U.S. PATENT DOCUMENTS

| | | | |
|---|---|---|---|
| 3,975,219 | 8/1976 | Allen et al. | 419/28 |
| 4,081,295 | 3/1978 | Vogel | 148/677 |
| 4,608,094 | 8/1986 | Miller et al. | 148/11.5 N |
| 4,814,023 | 3/1989 | Chang | 148/410 |
| 4,816,084 | 3/1989 | Chang | 148/675 |
| 4,820,358 | 4/1989 | Chang | 148/410 |
| 4,844,863 | 7/1989 | Miyasaka et al. | 419/28 |
| 4,907,947 | 3/1990 | Hoppin, III | 148/514 |
| 4,957,567 | 9/1990 | Krueger et al. | 148/410 |
| 5,061,324 | 10/1991 | Chang | 148/514 |
| 5,080,734 | 1/1992 | Krueger et al. | 148/410 |
| 5,087,305 | 2/1992 | Chang | 148/410 |
| 5,143,563 | 9/1992 | Krueger et al. | 148/410 |
| 5,312,497 | 5/1994 | Mathey | 148/676 |
| 5,393,483 | 2/1995 | Chang | 148/514 |
| 5,413,752 | 5/1995 | Kissinger | 419/29 |

FOREIGN PATENT DOCUMENTS

| | | | |
|---|---|---|---|
| 63-014802 | 1/1988 | Japan | 419/28 |

OTHER PUBLICATIONS

J. M. Hyzak et al., The Microstructural Response of As–HIP P/M U–720 to Thermomechanical Processing, Proceedings of the Seventh International Symposium on Superalloys, The Minerals, Metals & Materials Society, 1992, pp. 93–102.

*Primary Examiner*—David A. Simmons
*Assistant Examiner*—Margery S. Phipps
*Attorney, Agent, or Firm*—Andrew C. Hess; David L. Narciso

[57] ABSTRACT

A method is provided for obtaining a uniform grain size on the order of about ASTM 5 or coarser in at least a portion of an article formed from a γ' precipitation strengthened nickel-base superalloy. The method comprises forming an article by: providing a billet, preheating the billet above 2000° F. for at least 0.5 hours, working at least a portion to near-net shape at working conditions including a first strain rate of less than about 0.01 per second and at a subsolvus temperature at or near the recrystallization temperature, supersolvus heating to form a grain size in the portion of at least 5 ASTM, and cooling to reprecipitate γ' within the article. The method can be utilized to form a γ' precipitation strengthened nickel-base superalloy article whose grain size varies uniformly between portions thereof, so as to yield a desirable microstructure and property gradient in the article in accordance with the in-service temperature and stress-state gradient experienced by the article. The method is particularly useful for the making of relatively large components such as turbine disks used in gas turbine engines, which are subjected to stress and temperature conditions that vary radially from the center of the disk to its outer rim.

11 Claims, 1 Drawing Sheet

THERMOMECHANICAL PROCESSING METHOD FOR ACHIEVING COARSE GRAINS IN A SUPERALLOY ARTICLE

This invention relates to methods for processing a nickel-base superalloy so as to form articles having a high service temperature capability, in which a thermomechanical working operation is performed in order to achieve a microstructure characterized by a uniform grain size of ASTM 5 or coarser.

BACKGROUND OF THE INVENTION

As is known in the art, powder metal gamma prime (γ') precipitation strengthened nickel-base superalloys are capable of providing a good balance of creep, tensile and fatigue crack growth properties to meet the performance requirements of components used in gas turbine engines. Typically, such components are produced by some form of consolidation, such as extrusion consolidation, then isothermally forged to the desired outline, and finally heat treated. These processing steps are designed to retain a particular grain size within the component.

In order to improve the fatigue crack growth resistance and mechanical properties of these materials at elevated temperatures, these alloys are heat treated above the γ' solvus temperature (generally referred to as a supersolvus heat treatment), to cause significant, uniform coarsening of the grains, resulting in a grain size of as large as about ASTM 6. (Reference throughout to ASTM grain sizes is in accordance with the standard scale established by the American Society for Testing and Materials.) The term "uniform" with respect to grain growth means the substantial absence of non-uniform critical grain growth. Critical grain growth is defined as localized abnormal excessive grain growth to grain diameters exceeding a desired range, causing a detrimental effect on mechanical properties such as tensile and fatigue.

To meet the increasing demand for higher temperature capabilities for turbine disks used in gas turbine engines, it is necessary to achieve coarser grains in the rim portion of the disk where the operating temperature of the disk is highest, while finer grains are desired near the center bore of the disk in order to yield greater hardness and strength. Engineering estimates have indicated a substantial improvement in creep capability for a disk with coarse grains at its rim. For example, at a stress level of about 70,000 pounds per square inch, a superalloy material having a grain size of about ASTM 2 is estimated to provide an approximately 100° F. higher temperature capability than that possible with the same material having a grain size of about ASTM 6 when subjected to a 200 hour creep test to 0.2 inch. However, current practices have been unable to produce uniform grain sizes of coarser than about ASTM 5 in superalloy articles formed by powder metallurgy.

A thermomechanical process disclosed in U.S. Pat. No. 4,957,567 to Krueger et al., assigned to the assignee of this invention, discloses the production of uniform grain sizes ranging from ASTM 2–9. In practice, the process taught by Krueger et al. is employed to produce components with average grain sizes in the range of about ASTM 6 through 9, in that the process is less reliable in producing grain sizes in the range of ASTM 2 through 5.

Testing reported by J. M. Hyzak et al. at the Proceedings of the Seventh International Symposium on Superalloys, The Minerals, Metals & Materials Society, 1992, has suggested that grain coarsening of UDIMET 720 can be achieved during forging at temperatures near or above the γ' solvus temperature of the material. However, deformation by this technique is not superplastic, such that the extent of deformation is significantly limited. A propensity for grain boundary cracking has also been identified as a potential limitation of this process. Furthermore, possible uniform grain coarsening was not documented, and a propensity for critical grain growth exists with the Hyzak et al. process, which would result in an unacceptable forged product. Also, the method taught by J. M. Hyzak et al. is not amenable to high resolution sonic inspections due to the presence of as-forged coarse grains, nor is the method amenable to post forge supersolvus heat treatment due to the high risk of abnormal grain growth. Finally, the method taught by Hyzak et al. is generally incompatible with methods for producing dual alloy disks in that the preforms would not be fine grained and, therefore, superplastic deformation to achieve desired high strains at the bondline would not be possible.

Dual alloy disks and differentially heat treated monolithic disks known in the prior art tend to have dual microstructures, such that the bulk of the rim is one grain size and the bore is a uniform finer grain size. While the resulting dual property condition is an improvement over conventional monolithic disks, such improvements are still limited to a maximum grain size of about ASTM 6. Ideally, the grain size and microstructure of a disk should vary radially in keeping with the temperature and stress-state gradient experienced during operation, such as a grain size of at least about ASTM 5 and preferably coarser at the disk rim, and a grain size of about ASTM 10 at the disk bore. In addition, to achieve a suitable balance of mechanical properties such as burst strength, creep, low cycle fatigue, notch ductility and damage tolerance, accurate control of grain size is required.

Accordingly, what is needed is a process by which an article can be formed from a γ' precipitation strengthened nickel-base superalloy such that at least a portion of the article is characterized by a uniform grain size of at least about ASTM 5. Furthermore, it would be desirable if such a process achieved a grain size and microstructure which can be controlled to vary uniformly between portions of the article in accordance with the temperature and stress-state gradient experienced during operation of the article.

SUMMARY OF THE INVENTION

It is therefore an object of this invention to provide a method for making an article from a precipitation strengthened nickel-base superalloy powder, wherein a thermomechanical working step is utilized to form the superalloy article such that the entire article, or at least a portion of the article, is characterized by a uniform grain size of at least ASTM 5 after supersolvus heat treatment.

It is another object of this invention that such a thermomechanical working step employ strain rates and working temperatures such that a uniform fine grain size is present after working, the desired grain size is achieved in the article during supersolvus heat treatment, and the article is free from grain boundary cracking and other structural defects.

It is yet another object of this invention that such a thermomechanical working step be capable of forming the superalloy article such that the article is characterized by a gradient or differential microstructure in which grain sizes vary uniformly between portions of the article after supersolvus heat treatment.

It is a further object of this invention to provide a method for making such a nickel-base superalloy article, wherein additional processing is employed in the making of the superalloy article to further enhance the gradient microstructure and its resulting properties.

Lastly, it is still a further object of this invention that such methods be adaptable for forming dual property articles.

A method is provided for obtaining a uniform grain size on the order of about ASTM 5 or coarser in at least a portion of an article formed from a γ' precipitation strengthened nickel-base superalloy. The method can be utilized to form a γ' precipitation strengthened nickel-base superalloy article whose grain size varies uniformly between portions thereof, so as to yield a desirable microstructure and property gradient in the article in accordance with the in-service temperature and stress-state gradient experienced by the article. The method is particularly useful for the making of relatively large components such as turbine disks used in gas turbine engines, which are subjected to stress and temperature conditions that vary radially from the center of the disk to its outer rim.

The method of this invention includes forming a billet from a powder of a γ' precipitation strengthened nickel-base superalloy having a known recrystallization temperature and a γ' solvus temperature. The billet is then preheated at a 0 temperature and for a duration which is sufficient to yield throughout the billet a substantially uniform temperature of approximately that intended for subsequent thermomechanical processing. At least a portion of the billet is then thermomechanically processed at preselected working conditions such that an article is formed in which the worked portion is at near-net shape.

The preselected working conditions include a strain rate of less than about 0.01 per second and a minimum working temperature which is dependent on the carbide and γ' solvii temperatures of the superalloy, such that the working temperature is at or near the recrystallization temperature but below the γ' solvus temperature of the superalloy. As a result, grain growth within the worked portion of the article is strain rate dependent, and the worked portion has a precipitate of γ' and a uniform but fine grain size of finer than about ASTM 6. The article is then heated at a supersolvus solutioning temperature for a duration sufficient to solutionize at least some of the γ' and to coarsen the grains within the article such that the grain size within the worked portion is uniformly at least about 5 ASTM, and potentially as coarse as about ASTM 1. Finally, the article is cooled from the supersolvus solutioning temperature to room temperature so as to reprecipitate γ' within the article.

In accordance with the above, the method of this invention results in a superalloy article characterized by a coarse grain microstructure throughout the entire article, or at least a portion of the article. As such, the article is more readily capable of operating at temperatures of up to about 1500° F., exhibiting a combination of high strength and creep resistance.

In addition to the above, a dual property article can be formed by working a second portion of the same article at a second set of preselected working conditions which include a second strain rate which is higher than the strain rate for the first portion, and a second working temperature which is lower than the working temperature for the first portion, again such that grain growth is strain rate dependent. As a result, the second portion has a precipitate of γ' and a uniform grain size which is finer than the grain size of the first portion. Notably, the first and second portions may be regions of an article formed of a single superalloy, or they may be separate articles at this stage of processing and formed of different superalloys, with the first and second portions being joined following their respective hot working operations. The article is then heated as noted above to solutionize at least some of the γ' and to coarsen the grains within the article.

The result is a hot worked article characterized by a gradient microstructure between the first and second portions of the article, such that the article's mechanical properties correspond to operating conditions which vary over the article.

DETAILED DESCRIPTION OF THE INVENTION

Figure 1A:
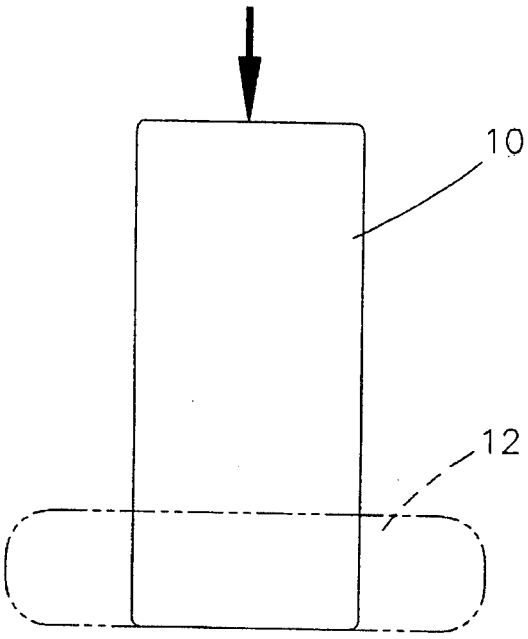
FIGS. 1*a* and 1*b* are graphical representations illustrating a first differential thermomechanical technique in accordance with this invention.

For γ' precipitation strengthened nickel-base superalloys, Al, Ti, Nb and/or Ta are the principal elements which combine with Ni to form the desired amount of γ' precipitate, principally $Ni_3(Al,Ti,Nb,Ta)$, while the elements Ni, Cr, W, Mo and Co are the principal elements which combine to form the gamma matrix. The principal high temperature carbide formed is of the MC type, in which M is predominantly Nb, Zr and Ti. With this type of alloy, the methods of this invention provide working and processing parameters which provide a worked article having a uniform grain size of ASTM 5 or greater and, if so desired, a grain size and microstructure which varies uniformly between predetermined regions of the article.

The ideal microstructure for articles such as a turbine disk for a gas turbine engine requires a gradient or differential grain size distribution in order to enhance the creep capability of the rim of the disk while emphasizing strength in the base of the disk, in which a bore is formed by which the disk is supported in the engine. For example, an improved microstructure for the disk would entail a grain size on the order of about ASTM 6 to 10 in the base, but a much larger grain size in the rim—for example, at least ASTM 5 but more preferably on the order of about ASTM 1 to 4. Ideally, the region of the disk between the rim and the base would have a grain size gradient that is intermediate that of the rim and base.

In accordance with this invention, the desired coarse uniform grain size of ASTM 5 or greater is achieved by a thermomechanical process in which the temperature and strain rate are critical. Furthermore, by utilizing a two-step thermomechanical process, incorporating the teachings of this invention, a monolithic or dual property disk can be produced having gradient properties.

The method of this invention utilizes the teachings of U.S. Pat. No. 4,957,567 to Krueger et al., which determined that when hot working a γ' precipitation strengthened nickel-base superalloy at elevated temperatures at or near its recrystallization temperature, grain growth is strain rate dependent. Therefore, the strain rate of these superalloy materials during hot deformation (i.e., temperatures at or near the alloy's recrystallization temperature but less than the alloy's γ' solvus temperature) is crucial to the development of the desired grain growth within the material during subsequent supersolvus heat treatment.

As also taught by Krueger et al., the strain rates experienced during hot deformation must remain below a relatively low critical strain rate, $\epsilon_c$, which is composition, microstructure and temperature dependent, so as to avoid non-uniform critical grain growth.

However, in accordance with this invention, it has been determined that the strain rates and working temperature must each be further controlled within a more specific range than that taught by Krueger et al. in order to reliably achieve a uniform grain size of coarser than ASTM 5. This desired uniform grain size of coarser than ASTM 5 has not been reliably achievable with the process method disclosed by Krueger et al.

While the teachings of this invention are applicable to γ' precipitation strengthened nickel-base superalloys in general, representative superalloys suitable for illustrating the advantages of this invention are disclosed in U.S. Pat. Nos. 4,957,567, 5,080,734 and 5,143,563, all of which are assigned to the assignee of this invention. The nominal compositions of four superalloys disclosed by these patents are provided below. However, the scope of this invention is not limited to these or any other specific compositions, but rather is directed to all γ' precipitation strengthened nickel-base superalloys.

| ELEMENT | ALLOY A | ALLOY B | ALLOY C | ALLOY D |
|---|---|---|---|---|
| Cobalt | 17.0–19.0 | 10.9–12.9 | 16.0–18.0 | 12.0–14.0 |
| Chromium | 11.0–13.0 | 11.8–13.8 | 14.0–16.0 | 15.0–17.0 |
| Molybdenum | 3.5–4.5 | 4.6–5.6 | 4.5–5.5 | 3.5–4.5 |
| Tungsten | — | — | — | 3.5–4.5 |
| Aluminum | 3.5–4.5 | 2.1–3.1 | 2.0–3.0 | 1.5–2.5 |
| Titanium | 3.5–4.5 | 4.4–5.4 | 4.2–5.2 | 3.2–4.2 |
| Niobium | 1.5–2.5 | 1.1–2.1 | 1.1–2.1 | 0.5–1.0 |
| Hafnium | — | — | — | to 0.3 |
| Vanadium | — | — | — | to 0.01 |
| Zirconium | to 0.06 | to 0.06 | to 0.8 | 0.01–0.06 |
| Carbon | 0.01–0.06 | 0.01–0.06 | 0.04–0.8 | 0.01–0.06 |
| Boron | 0.01–0.04 | 0.005–0.025 | 0.02–0.04 | 0.01–0.04 |
| Yttrium | — | — | — | to 0.01 |
| Nickel | Balance | Balance | Balance | Balance |

The recrystallization temperature for each of these alloys is approximately 1900° F., and the γ' solvus temperature is estimated to be in the range of about 2030° F.–2200° F., typically in the range of about 2120° F.–2180° F. for about 54 volume percent γ'. The calculated γ' content varies from about 43 to about 61 volume percent. The supersolvus solution temperature for an alloy is typically about 50° F. above its γ' solvus temperature.

Primarily, the method of this invention involves forming an article from a γ' precipitation strengthened nickel-base superalloy, such as Alloy A, by first forming a billet from a powder of the nickel-base superalloy. A suitable particle size for the powder is about −150 mesh or less, though larger and smaller particle sizes could be employed. In accordance with this invention, it has been determined that the size of the powder particles influences the grain size which can be achieved with the thermomechanical process of this invention, as will be discussed below. From such a superalloy powder, a powder metal compact of the superalloy can be produced using conventional extrusion consolidation methods and a reduction greater than about 4:1, which yields a fully dense, fine grain billet having at least about 98% theoretical density and an average grain size of about ASTM 12–16, though as large as ASTM 10.

The billet is then preheated prior to thermomechanical processing at a temperature and for a duration sufficient to yield a substantially uniform temperature throughout the billet. Most preferably, the temperature attained is that required for subsequent thermomechanical processing, as will be described below, though lower or higher temperatures could foreseeably be employed. Importantly, it has been determined that the duration of the preheat step has a significant effect on the ultimate grain size achieved in the resultant thermomechanically processed article. For example, a soak time increase from about thirty minutes to about three hours results in a final grain size increase of about 2 ASTM numbers. Therefore, the soak time can be intentionally varied within reasonable limits to alter the final grain size as desired.

The billet is then transferred to a press where it is isothermally forged. In accordance with this invention, the working conditions are selected such that a relatively uniform large grain size of at least about ASTM 5, and preferably a grain size on the order of ASTM 1 to 4, will be achieved after a supersolvus heat treatment.

In accordance with this invention, the processing window required to achieve the above entails a minimum working temperature and a maximum strain rate. The minimum working temperature is related to the carbide and γ' solvii temperatures of the particular superalloy of interest. For Alloys A through D, the minimum working temperature has been determined to be about 2000° F. Appropriate minimum working temperatures for other γ' nickel-base superalloys will differ slightly, and can be determined without undue experimentation by those skilled in the art. The maximum permitted working temperature is limited by the particular alloy's γ' solvus temperature, and is preferably about 25° to about 100° F. below its γ' solvus temperature.

The strain rate must be sufficiently low to ensure a low level of warm working of the alloy in order to minimize stored energy in the deformed grains, so as to allow uniform grain growth to progress during the final heat treatment to a coarse grain size. The strain rate must also be sufficiently low to avoid excessive formation of nucleation sites, so as to reduce the forming of new and finer grains. In practice, strain rates of less than about 0.01 per second have been found to yield suitable results.

As an example, for a powder mesh size of about −150 and having the composition of Alloy A, appropriate working conditions include forging at about 2000° F. to about 2125° F., more preferably 2050° F. to about 2075° F. and at a strain rate of preferably less than about 0.001 per second, and more preferably about 0.0001 to about 0.0008 per second. As noted above, the process window of this invention is a function of the powder mesh size. Powders having a mesh finer than −150 must be worked at hotter temperatures and lower strain rates, generally above about 2075° F. and below about 0.00032 per second, respectively.

Notably, strain rates of 0.01 per second or above may produce critical grain growth. Increased carbon levels were determined to reduce the incidence of critical grain growth, yet allowed the desired coarse grain size to be achieved if the strain level was sufficient. Higher strain levels, e.g., above about 0.5 true strain, are required throughout the article to prevent regions of fine grain size. True strain of at least about 0.5 ensures that sufficient energy is present to drive the grain growth process to the desired extent. In practice, carbon and nitrogen appear to have more influence on average grain size than boron, but some critical grain growth may occur with reduced boron levels. Therefore, in order to achieve an optimum grain boundary interstitial level, a maximum level for carbon, nitrogen and boron must be chosen so as not to restrict the desired overall grain growth, while the minimum level must be sufficient to prevent critical grain growth.

After forging, the article is heated at a supersolvus solutioning temperature for a duration sufficient to solutionize at least a portion of the γ' and to coarsen the grains within the article, so as to produce the desired uniform grain size noted above. Generally, solution heat treating for about 0.5 to about 4 hours is appropriate, with a duration of about 1 to about 2 hours being most preferred. The article is then cooled from the supersolvus solutioning temperature to room temperature so as to reprecipitate γ' within the article.

By employing the novel processing method described above, articles having a uniform grain size of ASTM 5 or greater are reliably achieved at production levels. Furthermore, articles having dual properties, such as that required for a turbine disk, can also be produced through a modification of the above.

Generally, a first portion of the billet is processed in accordance with the above technique, while a second portion of the billet is thermomechanically processed in which the strain rate for the second portion is greater than that of the first portion. In addition, the second portion can be worked at a temperature which is greater than that of the first portion, though below the γ' solvus temperature, such that the second portion has a precipitate of γ' and a uniform grain size which is finer than the grain size of the first portion after a supersolvus heat treatment—i.e., finer than about ASTM 5, and generally on the order of about ASTM 6 to 10.

Figure 1B:
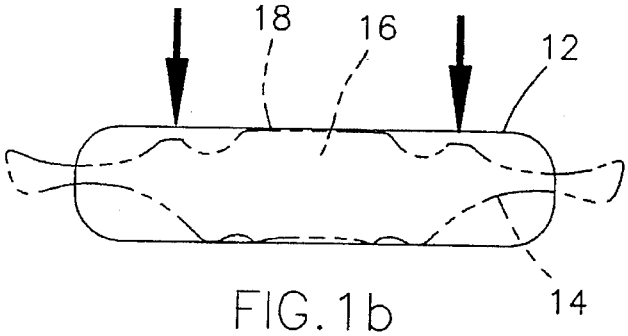

A representation of the above technique is illustrated in FIGS. 1*a* and 1*b*, in which a monolithic turbine disk 16 is formed from a billet 10 of a nickel-base superalloy, as described previously. After preheating for a sufficient duration, the billet 10 is isothermally forged to an intermediate near-net shape 12 from those portions of the billet 10 corresponding to the base 18 of the disk 16. The working conditions are selected to achieve a relatively uniform intermediate to fine grain size of about ASTM 6 to 10 after a supersolvus heat treatment.

For the superalloy of this example, such conditions include forging at about 1850° F. to about 1975° F. at a nominal strain rate below the critical strain rate, $\epsilon_c$, to prevent critical grain growth, typically on the order of less than 0.01 per second. The billet 10 is then transferred to a second press, where it is again isothermally forged, but at different conditions directed to that portion of the billet 10 corresponding to the rim 18 of the disk 16, such that the rim 14 is formed at near-net shape and such that the entire disk 16 is at near-net shape. The working conditions are those previously described to achieve a uniform grain size which is on the order of greater than or equal to about ASTM 5 after a supersolvus heat treatment. Thereafter, the disk 16 is heated at a supersolvus solutioning temperature and then cooled, as described previously.

Figure 2A:
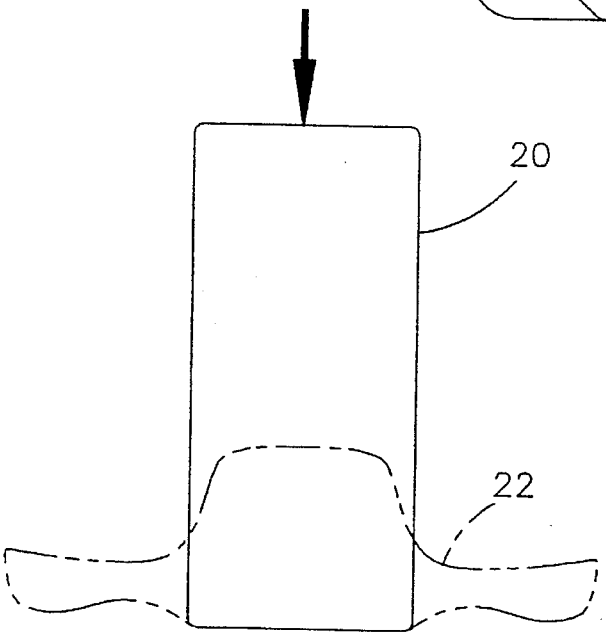
FIGS. 2*a* and 2*b* are graphical representations illustrating a second differential thermomechanical technique in accordance with this invention.
Figure 2B:
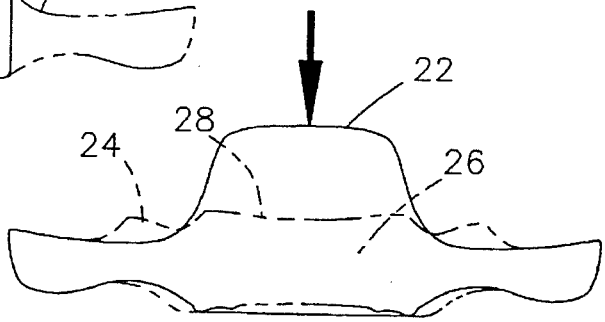

An alternative to the above process is illustrated in FIGS. 2*a* and 2*b*, in which a turbine disk 26 is formed from a billet 20 of a nickel-base superalloy, but isothermally forged in reverse order. The billet 20 is first isothermally forged to an intermediate near-net shape 22 from that portion of the billet 20 corresponding to the rim 24 of the disk 26. Thereafter, the billet 20 is again isothermally forged, but at different conditions directed to that portion of the billet 20 corresponding to the base 28 of the disk 26, such that the base 28 is formed at near-net shape and such that the entire disk 26 is at near-net shape.

In accordance with this invention, additional processing steps may be employed to achieve further enhancements in the gradient microstructure of the disks 16 or 26. Using a suitable fixture, such as that taught in U.S. patent application Ser. No. 07/860,880 to Ganesh et al., assigned to the same assignee of this invention, the disk 16, 26 is heated such that the rim 14, 24 and base 18, 28 are simultaneously exposed to different supersolvus solutioning temperatures, with the bulk of the base 18, 28 being maintained at a temperature well below that of the rim 14, 24, such as in accordance with that taught by U.S. Pat. No. 4,820,358 to Chang et al., assigned to the assignee of this invention.

Additional enhancements can be achieved through differential aging, in which the rim 14, 24 is aged at a higher temperature (e.g., about 1525° F.) and the base 18, 28 is aged at a lower temperature (e.g., about 1400° F.) to further promote the microstructure and property gradient across the disk 16, 26. This differential aging process can also be performed in the fixture noted above. As is known, aging is utilized to produce a turbine disk having a stabilized microstructure and an enhanced, optimum balance and combination of tensile, creep, stress rupture, low cycle fatigue and fatigue crack growth properties, particularly for use from ambient up to a temperature of about 1500° F. As with the heating and cooling steps described above, aging processes employed for particular materials are known to one skilled in the art and are not discussed in further detail here.

Finally, the above processes are adaptable for use with dual alloy disks known in the prior art. As is known, microstructural and property gradients can be achieved through appropriate differences in the chemistries of the regions corresponding to the rim 14, 24 and base 18, 28 of the disk 16, 26. In accordance with this invention, further enhancements can be achieved by separately forging near-net shape preforms corresponding to the rim 14, 24 and base 18, 28 using an appropriately modified version of the differential forging process described above. Thereafter, the preforms can be joined using known processes, such as forge enhanced bonding techniques as taught by U.S. Pat. No. 5,106,012 assigned to the assignee of this invention, to form the disk 16, 26, and then subjected to an appropriate differential heat treatment and/or aging and/or bore strengthening process in accordance with that described above.

In view of the above, a significant advantage of the method of this invention is that γ' precipitation strengthened nickel-base superalloy articles can be formed with a uniform grain size on the order of about ASTM 5, and preferably about 1 to 4 ASTM. Such a superalloy article is more readily capable of operating at temperatures of up to about 1500° F., and exhibits a combination of high strength and creep resistance at such temperatures.

In addition to the above, dual property articles can also be formed by working a portion of a superalloy article at a second set of preselected working conditions which include a second strain rate which is higher than the strain rate for the first portion, and a second working temperature which is lower than the working temperature for the first portion. Notably, the first and second portions may be regions of an article formed of a single superalloy, or they may be separate articles at this stage of processing and formed of different superalloys, with the first and second portions being joined following their respective hot working operations. The result is a superalloy article characterized by a gradient microstructure between the first and second portions of the article, such that the article's mechanical properties correspond to operating conditions which vary over the article. Specifically, turbine disks for gas turbine engines can be formed which are more capable of meeting the demand for a higher temperature capability. Advantageously, the method can be accomplished with existing classes of materials and equipment.

While this invention is particularly directed to achieving large grain sizes in articles formed from powder superalloys, it is believed that improvements in microstructural and property gradients can also be achieved in a wide range of starting input materials, including hot compacted powder, rapidly solidified materials such as sprayformed materials, fine grain powder metal billet, coarse grain powder metal billet produced by supersolvus heat treatment of fine grain billet, as well as fine and coarse grain cast and wrought materials.

In addition, the composition of the γ' precipitation strengthened nickel-base superalloy may vary widely so as to include alloys of this type having calculated high volume fractions of γ' content, varying from about 30 to about 70 volume percent.

Furthermore, other processing techniques of high volume fraction γ' superalloys, besides the powder metallurgy and hot isothermal processes disclosed, may also be employed.

Therefore, while our invention has been described in terms of a preferred embodiment, it is apparent that other forms could be adopted by one skilled in the art, such as by substituting other γ' precipitation strengthened nickel-base superalloys, or by substituting other processing steps or forms of the desired materials. Accordingly, the scope of our invention is to be limited only by the following claims.

What is claimed is:

1. A method for forming an article from a γ' precipitation strengthened nickel-base superalloy such that at least a portion of the article has a uniform grain size of at least ASTM 5, the method comprising the sequence of the steps of:

forming a billet from a powder of a nickel-base superalloy having a recrystallization temperature and a γ' solvus temperature;

preheating the billet at a temperature for a duration sufficient to yield a substantially uniform temperature of at least about 2000° F. throughout the billet, and maintaining the uniform temperature for a duration of at least about 0.5 hour;

working at least a first portion of the billet at preselected working conditions such that an article is formed in which the first portion is at near-net shape, the preselected working conditions including a first strain rate of less than about 0.01 per second, and a first working temperature at or near the recrystallization temperature but below the γ' solvus temperature such that the first portion has a precipitate of γ' and a uniform grain size of finer than about ASTM 6;

heating the article at a supersolvus solutioning temperature for a duration sufficient to solutionize at least some of the γ' and to coarsen the grains within the article such that the grain size within the first portion is at least 5 ASTM; and cooling the article from the supersolvus solutioning temperature to room temperature so as to reprecipitate γ' within the article.

2. A method as recited in claim 1 further comprising the steps of:

forming a second billet from a powder of a second γ' precipitation strengthened nickel-base superalloy having a recrystallization temperature and a γ' solvus temperature;

preheating the second billet at a temperature for a duration sufficient to yield a substantially uniform temperature throughout the second billet;

working the second billet at preselected working conditions such that a second portion is formed, the preselected working conditions including a second strain rate which is greater than the first strain rate and a second working temperature at or near the second recrystallization temperature of the second γ' precipitation strengthened nickel-base superalloy but below the second γ' solvus temperature of the second γ' precipitation strengthened nickel-base superalloy, such that the second portion has a precipitate of γ' and a uniform grain size of finer than about ASTM 6; and joining the first and second portions to form the article prior to the heating step;

wherein the heating step yields a grain size within the second portion which is finer than the grain size of the first portion.

3. A method as recited in claim 1 wherein the first strain rate is about 0.0001 to about 0.001 per second.

4. A method as recited in claim 1 wherein the duration of the preheating step is between about 0.5 and about 3 hours.

5. A method as recited in claim 1 wherein the powder has a mesh size of about −150 or less.

6. A method as recited in claim 1 wherein the first working temperature ranges from about 2000° F. to about 2125° F.

7. A method as recited in claim 1 further comprising the step of working a second portion of the billet at a second set of preselected working conditions such that the second portion is at near-net shape, the second set of preselected working conditions including a second strain rate which is greater than the first strain rate and a second working temperature at or near the recrystallization temperature but lower than the first working temperature, such that the second portion has a precipitate of γ' and a uniform grain size and such that the heating step yields a grain size within the second portion which is finer than the grain size of the first portion.

8. A method as recited in claim 7 wherein the heating step comprises a differential heat treatment in which the first portion is exposed to a first treatment temperature and the second portion is exposed to a second treatment temperature which is lower than the first treatment temperature.

9. A method as recited in claim 7 further comprising an aging step after the cooling step, wherein the aging step heats the first portion of the article to a first aging temperature and the second portion of the article to a second temperature which is lower than the first temperature, so as to stabilize the microstructure of the article.

10. A method for forming a turbine disk for a gas turbine engine from a γ' precipitation strengthened nickel-base superalloy such that at least a portion of the turbine disk has a uniform grain size of at least ASTM 5, the method comprising the sequence of the steps of:

providing a billet of a nickel-base superalloy having a recrystallization temperature and a γ' solvus temperature;

preheating the billet to a soak temperature of at least about 2000° F. and maintaining the soak temperature for at least 30 minutes up to about 3 hours so as to yield a substantially uniform temperature throughout the billet and so as to promote a coarser grain size in the turbine disk;

working a portion of the billet at a first set of preselected working conditions such that the portion forms a first portion of the turbine disk at near-net shape, the preselected working conditions including a first strain rate of about 0.0001 per second to about 0.001 per second, and a first working temperature of about 2000° F. to about 2125° F., the first working temperature being at or near the recrystallization temperature but below the $\gamma'$ solvus temperature such that the first portion has a precipitate of $\gamma'$ and a uniform grain size of finer than about ASTM 6;

working a remaining portion of the billet at a second set of preselected working conditions such that the remaining portion forms a second portion of the turbine disk at near-net shape and such that the entire turbine disk is at near-net shape, the second set of preselected working conditions including a second strain rate which is greater than the first strain rate and a second working temperature which is less than the first working temperature, such that the second portion has a precipitate of $\gamma'$ and a uniform grain size which is finer than the grain size of the first portion;

heating the turbine disk at a supersolvus solutioning temperature for a duration sufficient to solutionize at least some of the $\gamma'$ and to coarsen the grains within the turbine disk such that the grain size within the first portion is coarser than 5 ASTM and the grain size in the second portion is finer than that of the first portion; and cooling the turbine disk from the supersolvus solutioning temperature to room temperature so as to reprecipitate $\gamma'$ within the turbine disk.

11. A method as recited in claim 10 wherein the heating step comprises a differential heat treatment in which the first portion is exposed to a first treatment temperature and the second portion is exposed to a second treatment temperature which is lower than the first treatment temperature.

* * * * *